US012129634B2

(12) United States Patent
Yin

(10) Patent No.: US 12,129,634 B2
(45) Date of Patent: Oct. 29, 2024

(54) SINK SYSTEM

(71) Applicant: VETTA, LLC, Atlanta, GA (US)

(72) Inventor: Guoqiang Yin, Zhongshan (CN)

(73) Assignee: Vetta, LLC, Atlanta, GA (US)

( * ) Notice: Subject to any disclaimer, the term of this patent is extended or adjusted under 35 U.S.C. 154(b) by 155 days.

(21) Appl. No.: 17/821,485

(22) Filed: Aug. 23, 2022

(65) Prior Publication Data

US 2024/0068215 A1 Feb. 29, 2024

(51) Int. Cl.
*E03C 1/182* (2006.01)
*E03C 1/33* (2006.01)

(52) U.S. Cl.
CPC ..... *E03C 1/182* (2013.01); *E03C 1/335* (2013.01)

(58) Field of Classification Search
CPC ..... E03C 1/182; E03C 1/335; E03C 1/18
USPC .... 4/634, 631, 640, 639, 643, 650, 663, 549
See application file for complete search history.

(56) References Cited

U.S. PATENT DOCUMENTS 2,539,464 A * 1/1951 Norquist ..... E03C 1/182 D23/287
4,674,139 A * 6/1987 Walker ..... A47B 96/061 4/643
5,881,404 A * 3/1999 Knight ..... A47K 1/02 4/619
6,101,643 A * 8/2000 Moore ..... A47K 1/02 4/631
8,844,070 B2 * 9/2014 Booth ..... E03C 1/18 4/619
9,410,310 B1 * 8/2016 Eckert ..... E03C 1/324
9,492,010 B2 * 11/2016 Booth ..... E03C 1/18
10,151,085 B2 * 12/2018 Chong ..... A47K 1/04
10,226,122 B2 * 3/2019 Booth ..... A47B 77/022
10,422,115 B2 * 9/2019 Chong ..... E03C 1/33
10,501,919 B2 * 12/2019 Chong ..... E03C 1/335
10,844,582 B1 * 11/2020 Hocaoglu ..... E03C 1/182
11,066,817 B2 7/2021 Zeng
11,213,126 B2 * 1/2022 Artsiely ..... A47B 77/022
D946,718 S 3/2022 Zeng
11,324,318 B2 * 5/2022 Miller ..... A47B 96/201
11,680,395 B2 * 6/2023 Li ..... E03C 1/335 4/630
11,697,931 B2 * 7/2023 Levi ..... E03C 1/18 4/619
11,918,113 B2 * 3/2024 Booth ..... A47B 77/06
2008/0086812 A1 * 4/2008 Yu ..... E03C 1/18 4/639

(Continued)

FOREIGN PATENT DOCUMENTS

CA 3072734 A1 * 8/2020
CA 3131360 A1 * 3/2022 ..... E03C 1/12

(Continued)

*Primary Examiner* — Lori L Baker
(74) *Attorney, Agent, or Firm* — Thomas B. McGurk

(57) ABSTRACT

A sink system that has a sink assembly comprising a plurality of side wall plates and a bottom wall connected to the plurality of side wall plates. One or more of the sink side wall plates can comprise a first material. The first material can be an engineered stone composition. The sink system can comprise a countertop body. The countertop body can be formed of the first material. The sink system can comprise a plurality of sink columns cooperating with the plurality of sink side wall plates and bottom wall to form a sink basin.

19 Claims, 9 Drawing Sheets

(56) References Cited

U.S. PATENT DOCUMENTS

2010/0275368 A1* 11/2010 Miller ..... E03C 1/186 4/631
2012/0124737 A1* 5/2012 Gibson ..... E03C 1/055 4/643
2012/0222211 A1* 9/2012 Booth ..... E03C 1/18 4/619
2012/0222213 A1* 9/2012 Booth ..... E03C 1/33 29/525.01
2012/0255117 A1* 10/2012 Childs ..... E03C 1/262 4/679
2013/0212801 A1* 8/2013 Slayton ..... A47K 1/02 4/643
2014/0250589 A1* 9/2014 Sgarlata ..... A47K 1/05 29/527.1
2015/0067962 A1* 3/2015 O'Brien ..... A47J 47/005 4/630
2018/0106021 A1* 4/2018 Hall ..... E03C 1/055
2018/0142453 A1* 5/2018 Hocaoglu ..... E03C 1/335
2019/0203452 A1* 7/2019 Cullen ..... E03C 1/182
2020/0063412 A1* 2/2020 Miller ..... A47B 96/20
2020/0102727 A1* 4/2020 Li ..... E03C 1/182
2020/0277769 A1* 9/2020 Chong ..... E03C 1/0404
2021/0071400 A1* 3/2021 Hocaoglu ..... E03C 1/335
2022/0178122 A1* 6/2022 Grybush ..... E03C 1/182
2022/0282468 A1* 9/2022 Harris ..... E03C 1/33
2022/0307249 A1* 9/2022 Tyler ..... E03C 1/182
2022/0381018 A1* 12/2022 Reinhart ..... E03C 1/18
2023/0389700 A1* 12/2023 Booth ..... A47B 77/06
2024/0068215 A1* 2/2024 Yin ..... E03C 1/182

FOREIGN PATENT DOCUMENTS

CA 3139674 A1 * 5/2022 ..... E03C 1/182
CN 110461346 A * 11/2019
CN 110678750 A * 1/2020
CN 113175037 A * 7/2021 ..... E03C 1/181
EP 1911897 A1 * 4/2008
EP 3670768 A1 * 6/2020
EP 3901384 A1 * 10/2021 ..... E03C 1/18
EP 3933126 A1 * 1/2022 ..... A47B 77/06
GB 2264231 A * 8/1993 ..... E03C 1/12
WO WO-2008048381 A2 * 4/2008
WO WO-2023205101 A1 * 10/2023 ..... E03C 1/12

* cited by examiner

SINK SYSTEM

TECHNICAL FIELD

The present disclosure is directed generally to sink systems, and, more specifically, to multi-component sink assemblies and sink systems.

BACKGROUND

Conventional kitchen and bathroom countertops often are often made of some type of natural stone. These natural stone materials exhibit a variety of colors and patterns, depending upon the particular type of natural stone that is used. Conventional kitchen and bathroom sinks, on the other hand, usually are made of a material that differs from the natural stone material used to make the countertops installed with the sinks. As a result, kitchen and bathroom countertops typically exhibit an appearance with colors and patterns that differ from the appearances exhibited by the sinks installed with the countertops. With current technology, if a conventional sink is to be formed of the same natural stone material as the countertop with which it is used, then a block of that same natural stone must be hollowed out in order to form the sink. Such a process results in the use of a substantial amount of the natural stone material and the production of a significant amount of natural stone waste remnants.

Consequently, there is a need for sink systems that can address one or more of these and other shortcomings.

SUMMARY

The present disclosure encompasses a sink system comprising: a sink assembly comprising a front side wall plate, a rear side wall plate opposing the front side wall plate, a left side wall plate, a right side wall plate opposing the left side wall plate, a front left column attached to the front side wall plate and the left side wall plate, a front right column attached to the front side wall plate and the right side wall plate, a rear left column attached to the rear side wall plate and the left side plate, a rear right column attached to the rear side wall plate and the right side wall plate, and a bottom wall connected to the front side wall plate, the rear side wall plate, the left side wall plate, and the right side wall plate, wherein the bottom wall comprises a drain lip, wherein the drain lip defines a drain opening, and wherein the front side wall plate, the rear side wall plate, the left side wall plate, the right side wall plate, the front left column, the rear left column, the front right column, the rear right column, and the bottom wall cooperate to define a sink basin.

In one aspect, each of the front side wall plate, the rear side wall plate, the left side wall plate, the right side wall plate, the front left column, the rear left column, the front right column, and the rear right column comprises, consists essentially of, or consists of a first material. In another aspect, the first material is an engineered stone composition comprising, consisting essentially of, or consisting of a binder and a filler. In a further aspect, the bottom wall comprises, consists essentially of, or consists of a metal. In yet another aspect, the sink system comprises a countertop body connected to the sink assembly. In one aspect, the countertop and at least one of the front side wall plate, the rear side wall plate, the left side wall plate, the right side wall plate, the front left column, the rear left column, the front right column, and the rear right column the countertop body comprise a first material. In a further aspect, the sink bottom wall is connected to the front side wall plate, the rear side wall plate, the left side wall plate, and the right side wall plate by a plurality of fasteners. In yet another aspect, the sink assembly comprises a bracket aligned adjacent the sink bottom wall, wherein the bracket is connected to the sink bottom wall, the front side wall plate, the rear side wall plate, the left side wall plate, and the right side wall plate by the plurality of fasteners. In another aspect, each of the front left column, the rear left column, the front right column, the rear right column comprises an arcuate sink basin side.

The present disclosure also encompasses a sink system comprising: a countertop body comprising a first material; a sink assembly connected to the countertop body, wherein the sink assembly comprises a plurality of sink side wall plates, a plurality of sink columns, Wherein each sink column of the plurality of sink columns is attached to two sink side wall plates of the plurality of sink side wall plates, a sink bottom wall aligned adjacent to each sink side wall plate of the plurality of sink side wall plates and each sink column of the plurality of sink columns, wherein the sink bottom wall comprises a drain lip, wherein the drain lip defines a drain opening, wherein each sink side wall plate of the plurality of sink side wall plates comprises the first material, and wherein the sink bottom wall comprises a second material.

In one aspect, the first material is an engineered stone composition. In another aspect, the second material is a metal. In a further aspect, each sink column of the plurality of sink columns comprises the first material. In yet another aspect, the plurality of sink side wall plates is connected to the sink bottom wall by a plurality of fasteners. In another aspect, the sink assembly comprises a bracket aligned adjacent to the sink bottom wall. In still a further aspect, the sink assembly is connected to the countertop body by a plurality of fastener assemblies. In another aspect, each sink side wall plate of the plurality of sink side wall plates comprises a recess formed in an outer face of the sink side wall plate, and wherein a portion of a fastener assembly of the plurality of fastener assemblies is disposed in the recess.

The present disclosure also encompasses a sink system comprising: a sink assembly comprising a front side wall plate, a rear side wall plate opposing the front side wall plate, a left side wall plate, a right side wall plate opposing the left side wall plate, a front left column aligned adjacent the front side wall plate and the left side wall plate, a front right column aligned adjacent the front side wall plate and the right side wall plate, a rear left column aligned adjacent the rear side wall plate and the left side plate, a rear right column aligned adjacent the rear side wall plate and the right side wall plate, and a bottom wall aligned adjacent the front side wall plate, the rear side wall plate, the left side wall plate, and the right side wall plate, wherein the bottom wall comprises a drain lip, wherein the drain lip defines a drain opening, wherein the front side wall plate, the rear side wall plate, the left side wall plate, the right side wall plate, the front left column, the rear left column, the front right column, the rear right column, and the bottom wall cooperate to define a sink basin, and wherein each of the front left column, the rear left column, the front right column, the rear right column comprises an arcuate sink basin side.

In one aspect, the bottom wall is connected to the front side wall plate, the rear side wall plate, the left side wall plate, and the right side wall plate by a plurality of fasteners. In another aspect, the sink system comprises a countertop body connected to the sink assembly, wherein each of the countertop body, the front side wall plate, the rear side wall plate, the left side wall plate, the right side wall plate, the front left column, the rear left column, the front right column, and the rear right column comprises an engineered stone composition, and wherein the bottom wall comprises a metal.

These and other aspects of the present disclosure are set forth in greater detail below and in the drawings for which a brief description is provided as follows.

BRIEF' DESCRIPTION OF THE DRAWINGS

Figure 1:
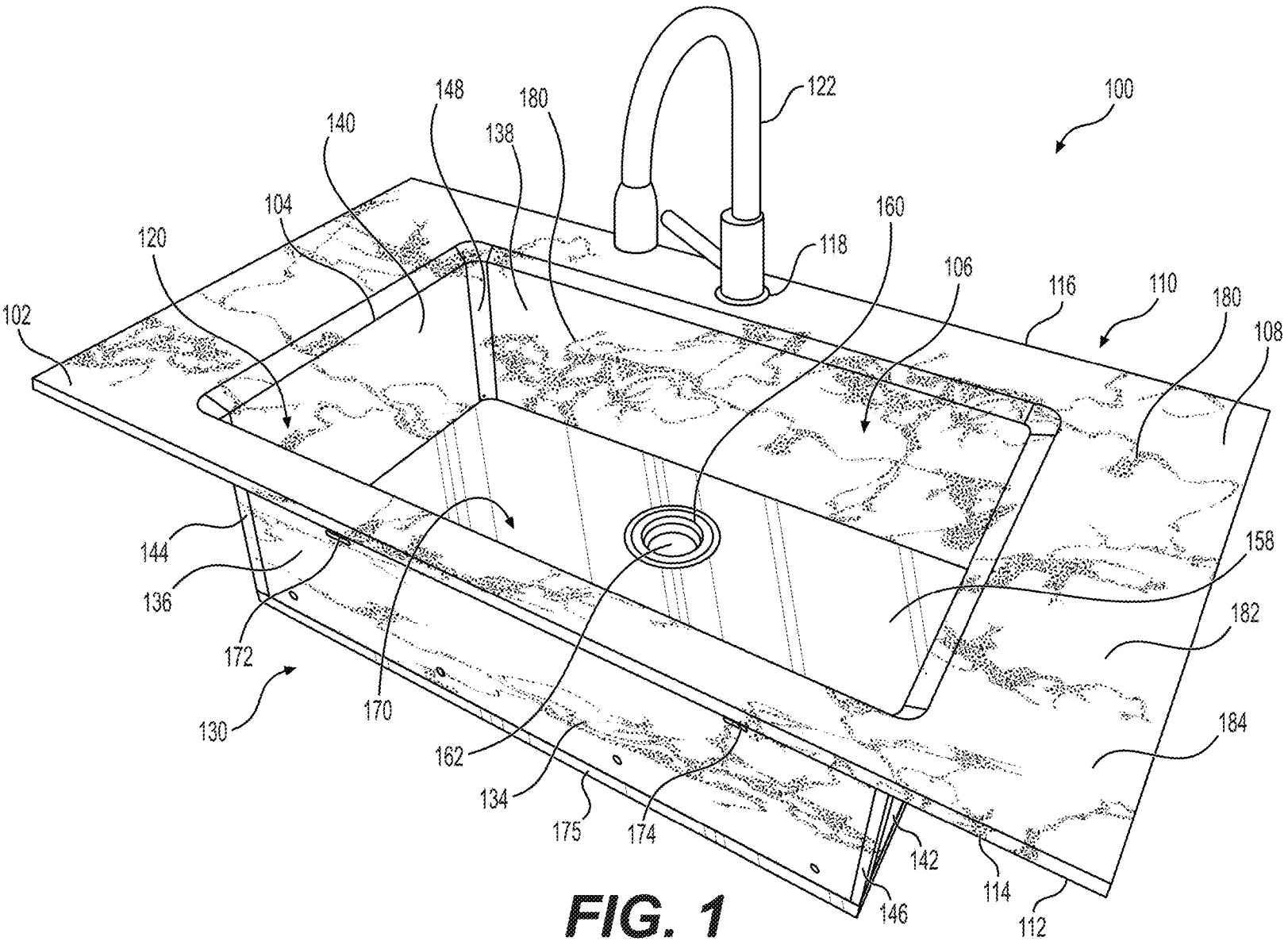
FIG. 1 is a perspective view of a sink system encompassing aspects of the present disclosure.
Figure 3:
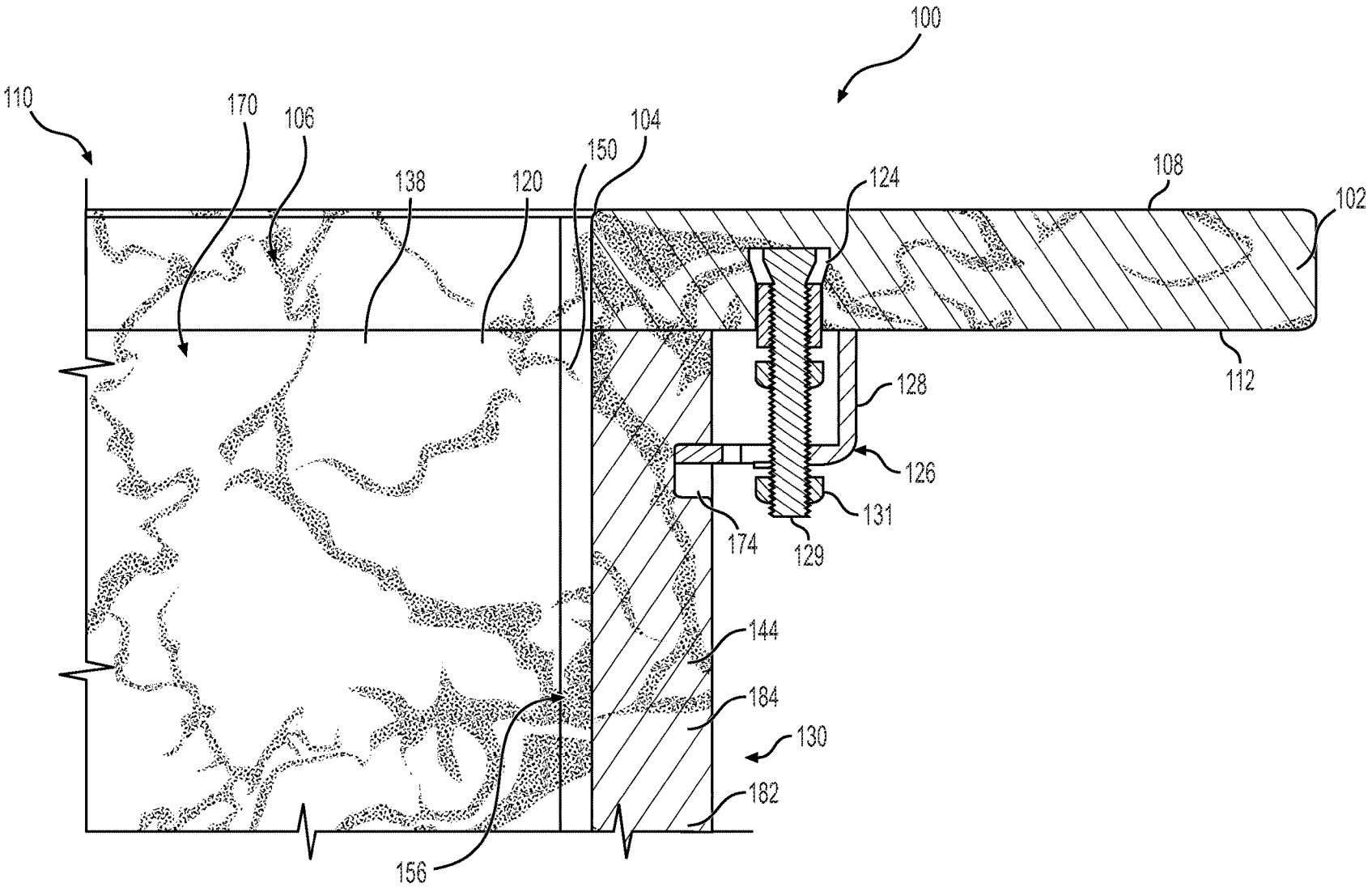

FIG. 3 is a partial sectional view of the sink system shown in FIG. 1 showing a portion of the rear side wall plate of the sink assembly, a cross-section of a portion of the right side wall plate of the sink assembly, a portion of the countertop body with a part of the countertop body portion in cross-section, and a cross-section of a fastener assembly connecting the right side wall plate to the countertop body.

Figure 4:
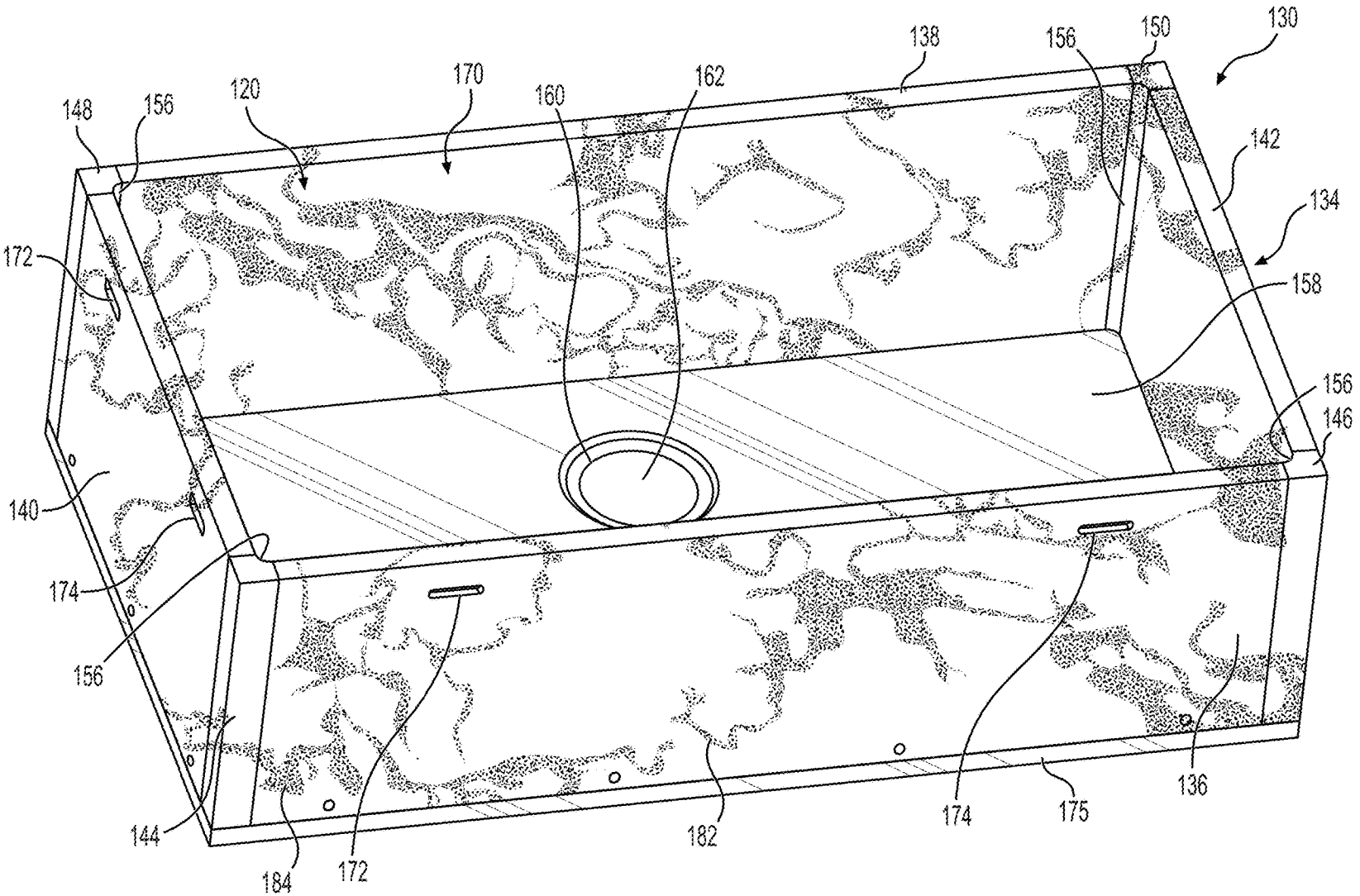

FIG. 4 is a perspective view of the sink assembly of the sink system shown in FIG. 1 with the countertop body, faucet, and fastener assemblies connecting the countertop body to the sink assembly removed.

Figure 5:
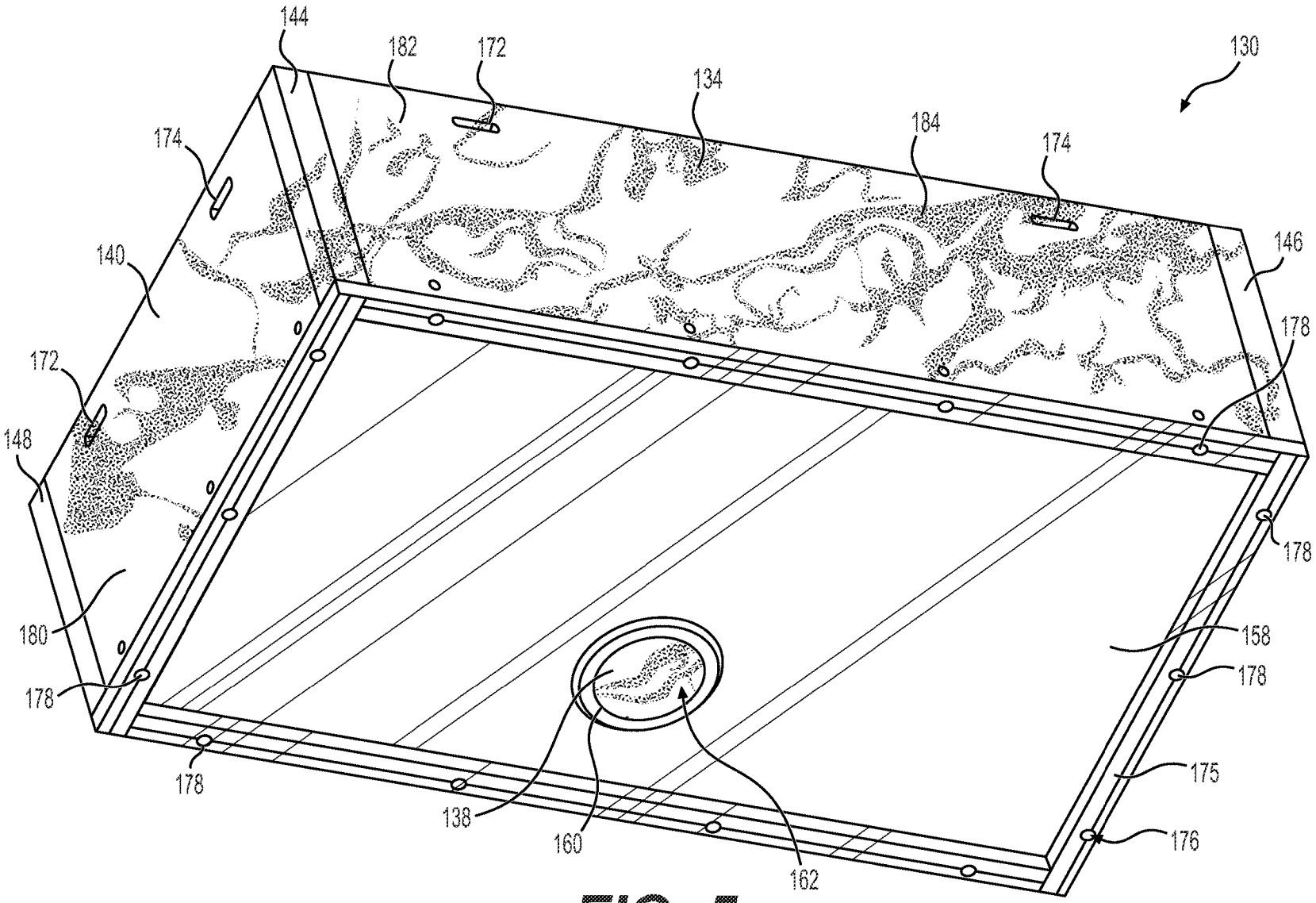

FIG. 5 is a lower perspective view of the sink assembly shown in FIG. 4.

Figure 6:
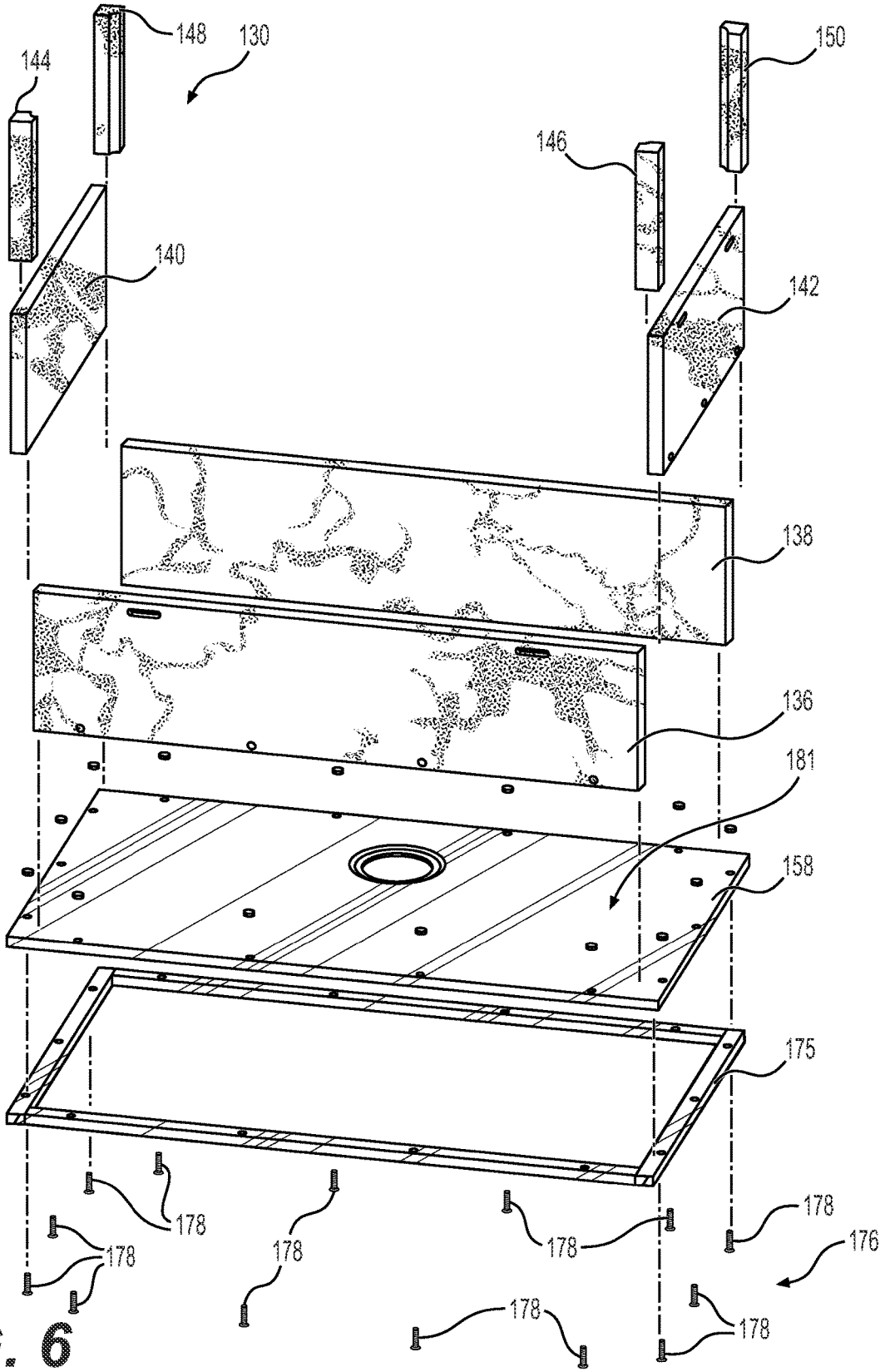

FIG. 6 is an exploded view of the sink assembly shown in FIG. 4.

Figure 7:
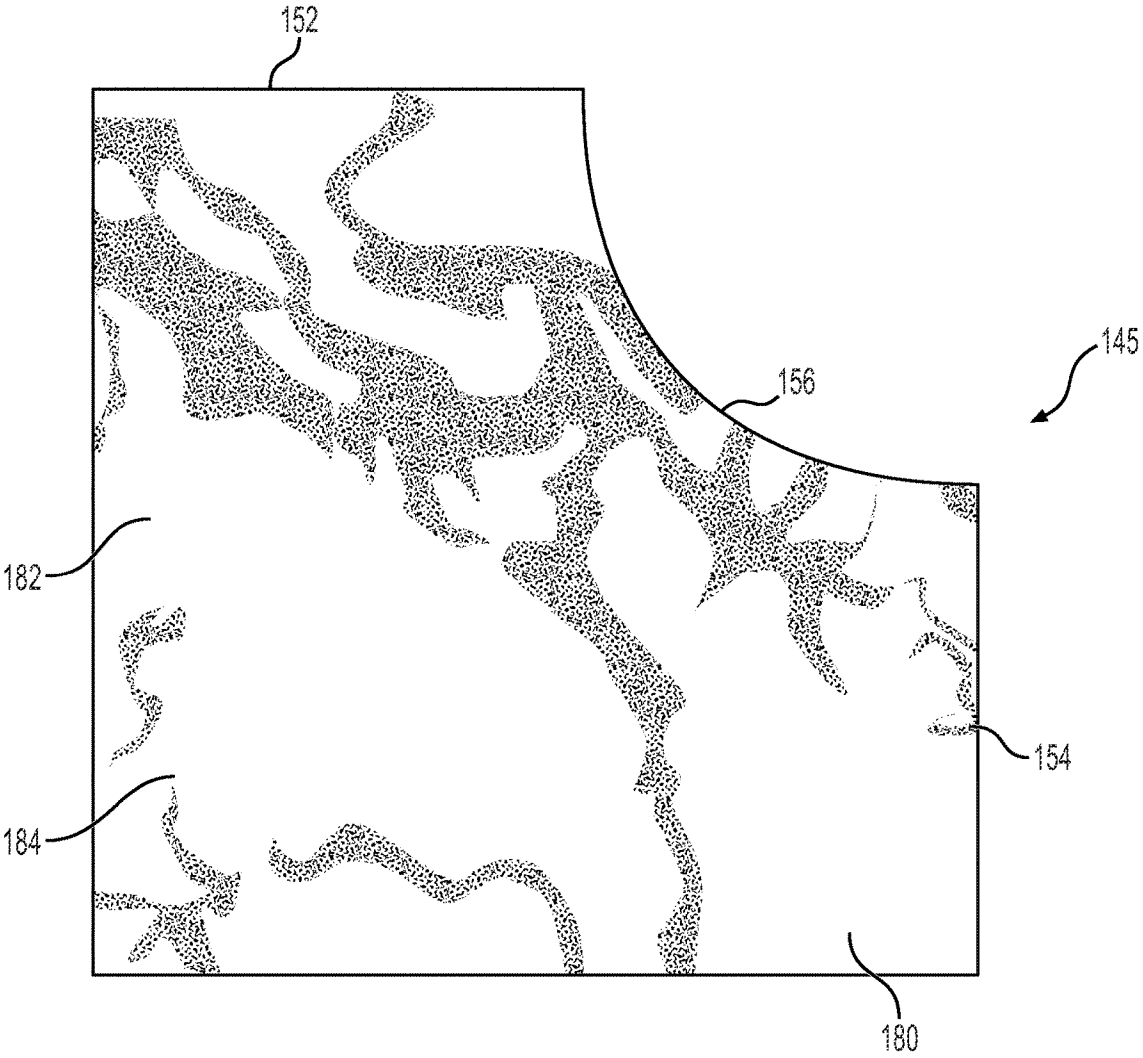

FIG. 7 is a top view of one of the sink columns shown in FIG. 6.

Figure 8:
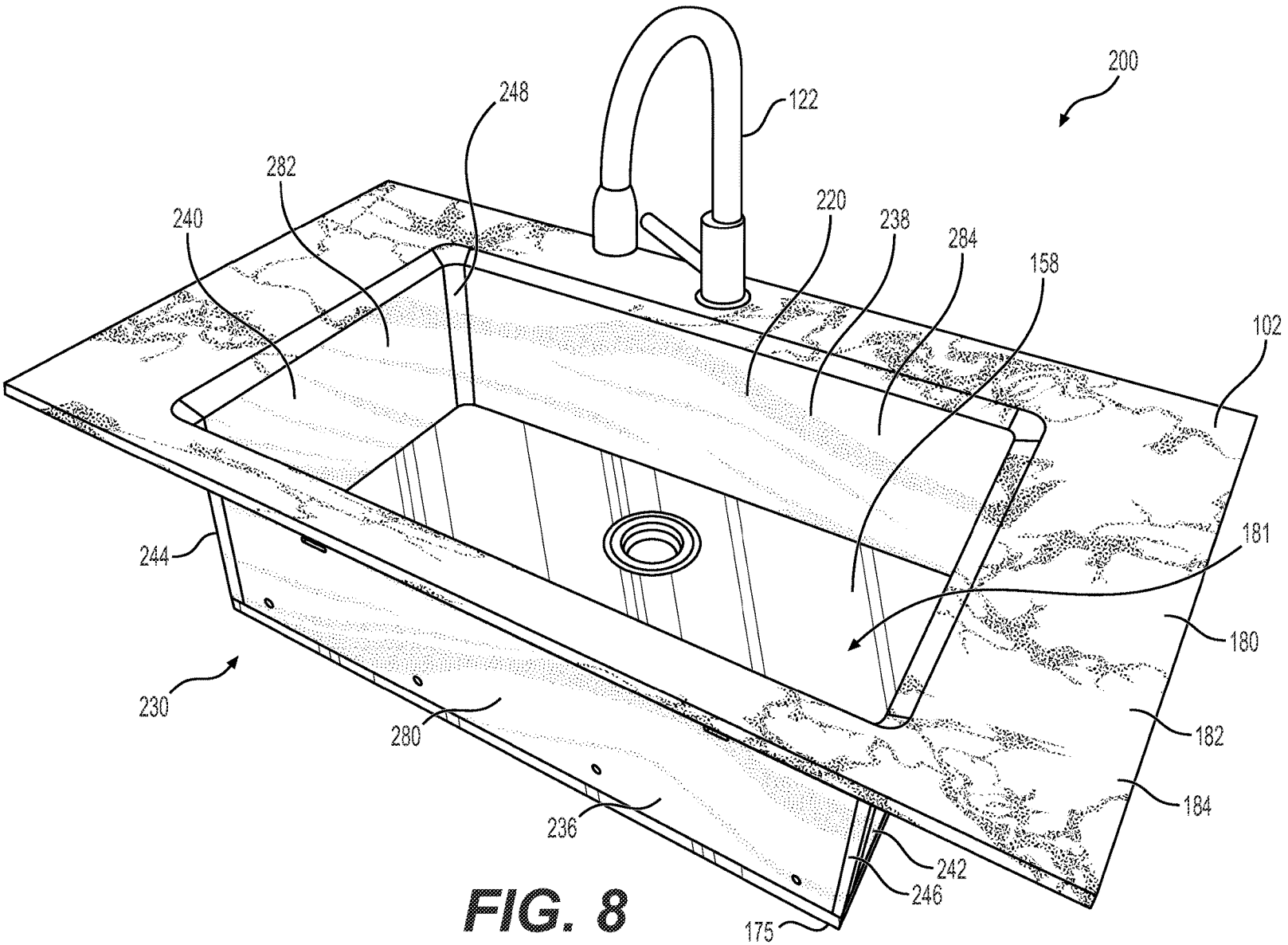

FIG. 8 is perspective view of another sink system encompassing aspects of the present disclosure in which the countertop body comprises a first material and each side wall plate of the plurality of side wall plates and each sink column of the plurality of sink columns of the sink assembly comprises a second material.

Figure 9:
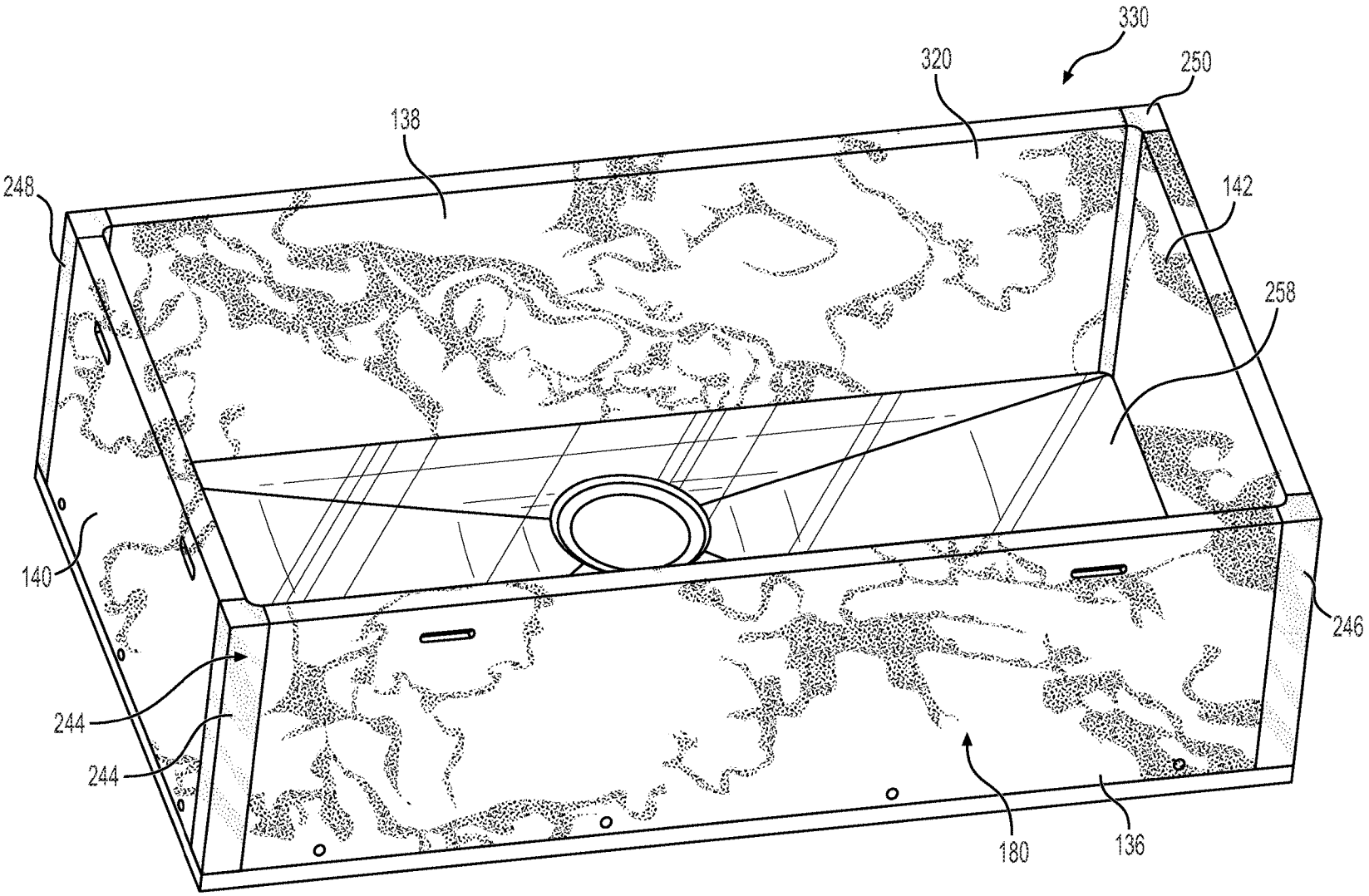

FIG. 9 is a perspective view of yet another sink system encompassing aspects of the present disclosure in which the sink assembly of the sink system comprises an alternatively contoured bottom wall, a plurality of sink side wall plates comprising a first material, and a plurality of sink columns comprising a second material.

DETAILED DESCRIPTION

The present disclosure encompasses sink systems and sink assemblies that can be used in kitchen, bathroom, and other installations in which sinks and/or sink-and-countertop combinations are used. The present disclosure refers in detail below to various aspects of the sink systems, which are illustrated in the accompanying drawings. The sink systems encompassed by the present disclosure encompass sink assemblies each with a plurality of sink side wall plates, a plurality of sink columns, and a sink bottom wall, all of which are connected and/or attached to each other and cooperate to form a sink basin. Wherever possible, the present disclosure uses the same reference numbers throughout the drawings to refer to the same or similar items.

As used herein, the singular forms of "a," "an," and "the" encompass the plural forms thereof unless otherwise indicated. As used herein, the phrase "at least one" includes all numbers of one and greater. As used herein, the term "and/or" refers to one or all of the listed elements or a combination of any two or more of the listed elements. As used herein, the phrase "integrally formed" means formed as a single, unitary body.

The sink systems encompassed by the present disclosure comprise components that can formed of engineered stone compositions, which comprise at least one binder and at least one type of tiller.

Figure 2:
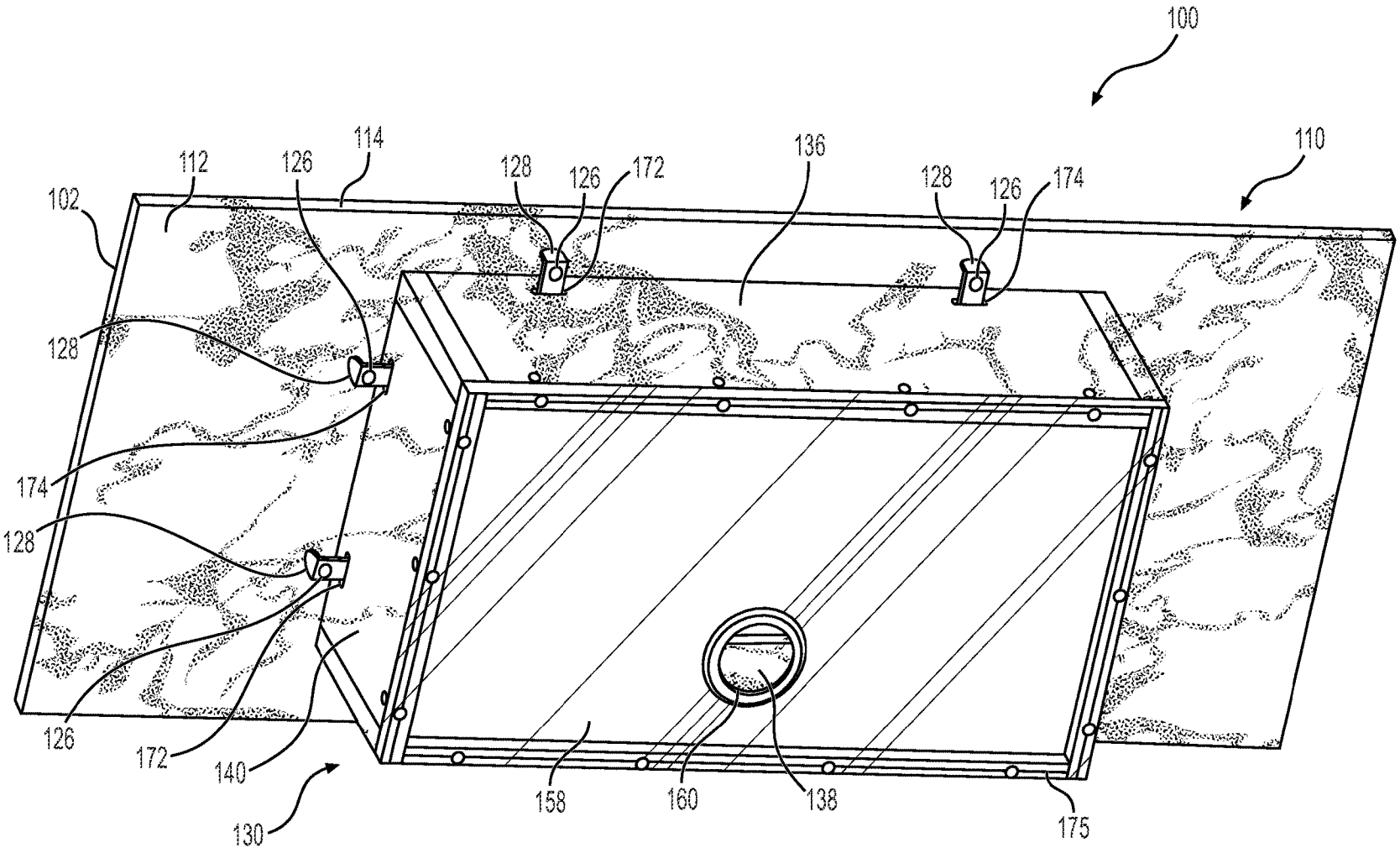
FIG. 2 is a lower perspective view of the sink system shown in FIG. 1.

FIGS. 1-7 illustrate a sink system 100 encompassing aspects of the present disclosure. As shown in FIGS. 1 and 2, the sink system 100 comprises a sink assembly 130 that comprises a plurality of sink side wall plates 134, a plurality of sink columns 145 attached to and disposed between the side wall plates of the plurality of sink side wall plates 134, and a bottom wall 158. The sink system 100 also can comprise a countertop body 102 connected to the sink assembly 130. Each sink side wall plate of the plurality of sink side wall plates 134, each sink column 145, and the bottom wall 158 are separately formed and then assembled together in constructing the sink assembly 130.

The plurality of sink side wall plates 134 comprises a front side wall plate 136, a rear side wall plate 138 aligned opposing the front side wall plate 136, a left side wall plate 140, and a right side wall plate 142 aligned opposing the left side wall plate 140. As shown in FIG. 6, each of the front side wall plate 136, the rear side wall plate 138, the left side wall plate 140, and the right side wall plate 142 is a rectangular plate having two opposing major faces and four edges. The two opposing major faces and the four edges of each of the front side wall plate 136, the rear side wall plate 138, the left side wall plate 140, and thy: right side wall plate 142 are flat. The inner major face of each of front side wall plate 136, the rear side wall plate 118, the left side wall plate 140, and the right side wall plate 142 forms a portion of the inner surface of a sink basin 120.

Each of the front side wall plate 136, the rear side wall plate 138, the left side wall plate 140, and the right side wall plate 142 comprises a first material 180. In one aspect, the first material 180 can be an engineered stone composition, which comprises a binder 182 and a filler 184. The engineered stone composition can be an engineered quartz in which the binder 182 is a polymeric resin and the filler 184 is a quartz aggregate. Alternatively, the engineered stone composition can be an engineered stone in which the binder 182 is a polymeric resin and the filler is a stone aggregate. Additionally, the engineered stone composition can be an engineered marble in which the binder 182 is a polymeric resin and the filler is a marble aggregate. Furthermore, the engineered stone composition can be a concrete in which the binder 182 is a polymer resin and the filler 184 is one or more of a quartz aggregate, a silica aggregate, a granite aggregate, a limestone aggregate, and/or other concrete aggregate. The engineered stone composition can include one or more mineral-coloring pigments. Slabs and plates of comprising various engineered stone compositions that can be used in the production of the countertop bodies, the sink columns and the side wall plates of the sink systems encompassed by the present disclosure are available from various sources, including Vetta, LLC located in Atlanta, Georgia, USA.

In one aspect, at least one of the front side wall plate 136, the rear side wall plate 138, the left side wall plate 140, and the right side wall plate 142 comprises the first material 180. In another aspect, each of the front side wall plate 136, the rear side wall plate 138, the left side wall plate 140, and the right side wall plate 142 comprises the first material 180. In a further aspect, each of the front side wall plate 136, the rear side wall plate 138, the left side wall plate 140, and the right side wall plate 142 consists essentially of the first material 180. In yet another aspect, each of the front side wall plate 136, the rear side wall plate 138, the left side wall plate 140, and the right side wall plate 142 consists of the first material 180. Each of the front side wall plate 136, the rear side wall plate 138, the left side wall plate 140, and the right side wall plate 142 can be integrally formed as a unitary body composed of only the first material 180.

The plurality of sink columns 145 comprises a front left column 144, a front right column 146, a rear left column 148, and a rear right column 150. The front left column 144 is aligned at the front left corner of the sink basin 120 and disposed adjacent to the left side wall plate 140 and the front side wall plate 136. The front right column 146 is aligned at the front right corner of the sink basin 120 and disposed adjacent to the front side wall plate 136 and the right side wall plate 142. The rear left column 148 is aligned at the rear left corner of the sink basin 120 and disposed adjacent to the left side wall plate 140 and the rear side wall plate 138. The rear right column 150 is aligned at the rear right corner of the sink basin 120 and disposed adjacent to the rear side wall plate 138 and the right side wall plate 142. Each of the front left column 144, the front right column 146, the rear left column 148, and the rear right column 150 can be attached to the two adjacent side wall plates with an adhesive and/or a sealant and/or an adhesive/sealant that is suitable for applications exposed to water.

As shown in FIG. 7, each sink column 145, including the front left column 144, the front right column 146, the rear left column 148, and the rear right column 150, can comprise a first plate side 152, a second plate side 154, and a sink basin side 156. The sink basin side 156 is disposed between the first plate side 152 and the second plate side 154. The sink basin side 156 is arcuate and can form a portion of the inner surface of the sink basin 120. The sink basin side 156 of each of the front left column 144, the front right column 146, the rear left column 148, and the rear right column 150 can extend from the top side of the column to the bottom side of the column. Each sink column 145 can be attached to the two adjacent side wall plates by applying an adhesive and/or a sealant and/or an adhesive/sealant to the first plate side 152 and the second plate side 154 and pressing the adjacent edge of each of the two side wall plates against the respective side of the sink column 145 so as to attach the two adjacent side wall plates to the sink column 145. The sink basin 120 can therefore comprise an inner surface that has four flat sides, formed by the flat inner major face of each of the front side wall plate 136, the rear side wall plate 138, the left side wall plate 140, and the right side wall plate 142, and four arcuate corners, formed by the sink basin side of each of the front left column 144, the front right column 146, the rear left column 148, and the rear right column 150.

In one aspect, at least one of the front left column 144, the front right column 146, the rear left column 148, and the rear right column 150 can comprise the first material 180. In another aspect, each of the front left column 144, the front right column 146, the rear left column 148, and the rear right column 150 comprises the first material 180. In further aspect, each of the front left column 144, the front right column 146, the rear left column 148, and the rear right column 150 consists essentially of the first material 180. In yet another aspect, each of the front left column 144, the front right column 146, the rear left column 148, and the rear right column 150 consists of the first material 180.

As shown in FIGS. 1-3, the countertop body 102 comprises a countertop top side 108, a countertop bottom side 112 opposing the countertop top side 108, a counter top front side 114, and a counter top rear side 116 opposing the counter top front side 114. The countertop body 102 can have a countertop lip 104 formed therein, wherein the countertop lip 118 defines a countertop opening 106 that extends through the countertop body 102 from the countertop top side 108 to the countertop bottom side 112. The countertop body 102 also can have formed therein a countertop faucet lip 118 that defines a faucet opening in which a faucet 122 can be disposed. The countertop body 112 can be provided as a unitary body. The countertop body 102 can comprises the first material 180.

The sink assembly 130 is connected to the countertop body 102 so that the sink basin 120, which comprises a basin opening 170, defined by the plurality of sink side wall plates 134 and the plurality of sink columns 145, is aligned with the countertop opening 106 to allow access to the sink basin 120 through the countertop opening 106. An adhesive and/or a sealant: and/or an adhesive/sealant can be applied between the countertop lip 104 and the top edges of the plurality of sink side wall plates 134 and the plurality of sink columns 145 so as to seal the countertop body 102 and the sink basin 120.

In one aspect, the countertop body 102 comprises the first material 180. In another aspect, the countertop body 102 consists essentially of the first material 180. In a further aspect, the countertop body 102 consists of the first material 180.

A shown in FIG. 3, the sink system 100 can comprise one or more fastener assemblies 126 that connect the sink assembly 130 to the countertop body 102. A plurality of fastener assemblies 126 can be used to connect the sink assembly 130 to the countertop body 102. Each fastener assembly 126 can comprise a screw 129, a portion of which is disposed in a countertop fastener recess 124 formed in the countertop bottom side 112. The fastener assembly 126 also can comprise a nut 131 and a fastener bracket 128. The screw 129 is operably connected to at least one nut 131 and the fastener bracket 128. A portion of each fastener bracket 128 of the plurality of fastener assemblies 126 is disposed in one of the first plate fastener recess 172 or the second plate fastener recess 174 formed in the outer major face of each of the front side wall plate 136, the rear side wall plate 138, the left side wall plate 140, and the right side wall plate 142. Each fastener assembly 126 can support the sink assembly 130 in a sink system 100 installation in which the sink assembly is suspended from the countertop body 102.

As shown in FIGS. 1, 2 and 4-6, the sink assembly 130 comprises a bottom wall 158 that is aligned adjacent the plurality of sink side wall plates 134 and the plurality of sink columns 145. The bottom wall 158 comprises a bottom wall lip 160 that defines a drain opening 162, thereby forming the drain of the sink basin 120. The bottom wall 158 forms at least a portion and/or all of the bottom surface of the sink basin 120. The bottom wall 158 is aligned adjacent and connected to each of the front side wall plate 136, the rear side wall plate 138, the left side wall plate 140, and the right side wall plate 142.

The sink assembly 130 also comprises a bracket 175 that is aligned adjacent and/or below and connected to the bottom wall 158. The bracket 175 is rectangular and sized to be aligned along the bottom outer edges of the sink assembly 130. The bracket 175 and the bottom wall 158 are connected to the plurality of sink side wall plates 134 by a plurality of fasteners 176. The plurality of fasteners 176 can comprise bracket screws 178. The bracket 175 and the bottom wall 158 can be connected to each of the front side wall plate 136, the rear side wall plate 138, the left side wall plate 140, and the right side wall plate 142 by one or more of the bracket screws 178. Each of the front side wall plate 136, the rear side wall plate 138, the left side wall plate 140, the right side wall plate 142, the bottom wall 158 and the bracket 175 can comprise holes formed therein that align with the corresponding holes on the respective side wall plate, the bottom wall 158, and the bracket 175 to allow a fastener to be aligned in all three respective holes. The plurality of fasteners 176 can also comprise nuts and/or washers that cooperate with the bracket screws 178 to secure the bottom wall 158 and the bracket 175 to the plurality of side wall plates 134.

In one aspect, the bottom wall 158 comprises a second material 181. In another aspect, the second material 181 is a metal. The bottom wall 158 can be formed of stainless steel or other suitable material for use in a sink basin. In a further aspect, the bottom wall 158 can be a flat plate of stainless steel.

As shown in FIG. 8, the present disclosure encompasses a sink system 200 that comprises the countertop body 102 and a sink assembly 230. The sink assembly 230 comprises a front side wall plate 236, a rear side wall plate 238 aligned opposing the front side wall plate 236, a left side wall plate 240, a right side wall plate 242 opposing the left side wall plate 140, a front left column 244, a front right column 246, a rear left column 248, and a rear right column 250. The countertop body 102 comprises a first material 180. The first material 180 is an engineered stone composition comprising a binder 182 and a filler 184. Each of the front side wall plate 236, the rear side wall plate 238, the left side wall plate 240, the right side wall plate 242, the front left column 244, the front right column 246, the rear left column 248, and the rear right column 250 comprises a second material 280. The second material 280 can be a second type of engineered stone composition comprising a second binder 282 and a second filler 284 that combined exhibit a different appearance from the appearance of the first material 180. As a result, the sink basin 220 exhibits a different appearance from the appearance exhibited by the countertop body 102. Accordingly, the sink systems encompassed by the present disclosure can exhibit a variety of appearance combinations.

As shown in FIG. 9, the present disclosure encompasses a sink assembly 330 comprising a front side wall plate 136, a rear side wall plate 138 aligned opposing the front side wall plate 136, a left side wall plate 140, and a right side wall plate 142 opposing the left side wall plate 140. The sink assembly 330 also comprises a front left column 244 aligned at the front left corner of the sink basin 320 and disposed adjacent to the left side wall plate 140 and the front side wall plate 136, a front right column 246 aligned at the front right corner of the sink basin 320 and disposed adjacent to the front side wall plate 136 and the right side wall plate 142, a rear left column 248 aligned at the rear left corner of the sink basin 120 and disposed adjacent to the left side wall plate 140 and the rear side wall plate 138, and a rear right column 250 aligned at the rear right corner of the sink basin 320 and disposed adjacent to the rear side wall plate 138 and the right side wall plate 142. The sink assembly 330 also comprises a bottom wall 258 that cooperates with the side wall plates and the sink columns to form the sink basin 320. The bottom wall 258 is concave and formed of metal, such as stainless steel.

Each of the front side wall plate 136, the rear side wall plate 138, the left side wall plate 140, and the right side wall plate 142 comprises a first material 180. Each of the front left column 244, the front right column 246, the rear left column 248, and the rear right column 250 comprises a second material 280. As a result, the appearance of each of the front side wall plate 136, the rear side wall plate 138, the left side wall plate 140, and the right side wall plate 142 differs from the appearance of each of the front left column 244, the front right column 246, the rear left column 248, and the rear right column 250. Accordingly, the sink basin 320 exhibits yet another overall appearance that differs from the overall appearances of the sink basins 120 and 220. As illustrated, the sink systems encompassed by the present disclosure can exhibit a variety of appearance combinations. The first materials 180 and the second materials 280 can be formed of various engineered stone compositions as described herein.

The sink systems encompassed by the present disclosure can be installed in kitchen, bathroom, restroom and other types of rooms in which sinks and counters are used. Other embodiments of the present disclosure will be apparent to those skilled in the art from their consideration of the specification and practice of the present disclosure disclosed in this document. The applicant intends that the specification and examples be considered as exemplary only, with the true scope and spirit of the present disclosure being indicated by the following claims.

What is claimed is:

1. A sink system comprising:

a sink assembly comprising a front side wall plate, a rear side wall plate opposing the front side wall plate, a left side wall plate, a right side wall plate opposing the left side wall plate, wherein each of the left side wall plate the right side wall plate, the front side wall plate, and the rear side wall plate comprises a flat inner major face and at least four flat edges, a front left column attached to and disposed between the front side wall plate and the left side wall plate, a front right column attached to and disposed between the front side wall plate and the right side wall plate, a rear left column attached to and disposed between the rear side wall plate and the left side plate, a rear right column attached to and disposed between the rear side wall plate and the right side wall plate, wherein each of the front left column, the front right column, the rear left column, and the rear right column comprises a first plate side, a second plate side, and an arcuate sink basin side disposed between the first plate side and the second plate side, and a bottom wall connected to the front side wall plate, the rear side wall plate, the left side wall plate, and the right side wall plate, wherein the bottom wall comprises a drain lip, wherein the drain lip defines a drain opening, and wherein the front side wall plate, the rear side wall plate, the left side wall plate, the right side wall plate, the front left column, the rear left column, the front right column, the rear right column, and the bottom wall cooperate to define a sink basin, and wherein each of the front side wall plate, the rear side wall plate, the left side wall plate, the right side wall plate, the front left column, the rear left column, the front right column, and the rear right column comprises an engineered stone composition comprising a binder and a filler.

2. The sink system of claim 1, wherein the bottom wall comprises a metal.

3. The sink system of claim 1, comprising a countertop body connected to the sink assembly, and wherein the countertop body comprises the engineered stone composition.

4. The sink system of claim 1, wherein the sink bottom wall is connected to the front side wall plate, the rear side wall plate, the left side wall plate, and the right side wall plate by a plurality of fasteners.

5. The sink system of claim 4, wherein the sink assembly comprises a bracket aligned adjacent the sink bottom wall, wherein the bracket is connected to the sink bottom wall, the front side wall plate, the rear side wall plate, the left side wall plate, and the right side wall plate by the plurality of fasteners.

6. A sink system comprising:

a countertop body comprising an engineered stone composition comprising a binder and a filler;

a sink assembly connected to the countertop body, wherein the sink assembly comprises a plurality of sink side wall plates, a plurality of sink columns, wherein each sink column of the plurality of sink columns is attached to and disposed between two sink side wall plates of the plurality of sink side wall plates, a sink bottom wall aligned adjacent to each sink side wall plate of the plurality of sink side wall plates and each sink column of the plurality of sink columns, wherein the sink bottom wall comprises a drain lip, wherein the drain lip defines a drain opening, and wherein each sink side wall plate of the plurality of sink side wall plates comprises the engineered stone composition.

7. The sink system of claim 6, wherein the sink bottom wall comprises a metal.

8. The sink system of claim 6, wherein each sink column of the plurality of sink columns comprises the engineered stone composition.

9. The sink system of claim 6, wherein the plurality of sink side wall plates is connected to the sink bottom wall by a plurality of fasteners.

10. The sink system of claim 6, the sink assembly comprises a bracket aligned adjacent to the sink bottom wall.

11. The sink system of claim 6, wherein the sink assembly is connected to the countertop body by a plurality of fastener assemblies.

12. The sink system of claim 10, wherein each sink side wall plate of the plurality of sink side wall plates comprises a recess formed in an outer major face of the sink side wall plate, and wherein a portion of a fastener assembly of the plurality of fastener assemblies is disposed in the recess.

13. A sink system comprising:

a sink assembly comprising a front side wall plate, a rear side wall plate opposing the front side wall plate, a left side wall plate, a right side wall plate opposing the left side wall plate, a front left column disposed between the front side wall plate and the left side wall plate, a front right column disposed between the front side wall plate and the right side wall plate, a rear left column disposed between the rear side wall plate and the left side plate, a rear right column disposed between the rear side wall plate and the right side wall plate, and a bottom wall aligned adjacent the front side wall plate, the rear side wall plate, the left side wall plate, and the right side wall plate, wherein the bottom wall comprises a drain lip, wherein the drain lip defines a drain opening, wherein the front side wall plate, the rear side wall plate, the left side wall plate, the right side wall plate, the front left column, the rear left column, the front right column, the rear right column, and the bottom wall cooperate to define a sink basin, and wherein each of the front left column, the rear left column, the front right column, the rear right column comprises an arcuate sink basin side, and wherein each of the front side wall plate, the rear side wall plate, the left side wall plate, and the right side wall plate comprises an engineered stone composition comprising a binder and a filler.

14. The sink system of claim 13, wherein the bottom wall is connected to the front side wall plate, the rear side wall plate, the left side wall plate, and the right side wall plate by a plurality of fasteners.

15. The sink system of claim 13, comprising a countertop body connected to the sink assembly, wherein the countertop body comprises the engineered stone composition.

16. The sink system of claim 13, wherein each of the front left column, the rear left column, the front right column, and the rear right column comprises the engineered stone composition.

17. The sink system of claim 13, wherein the bottom wall comprises a metal.

18. The sink system of claim 13, wherein each of the front side wall plate, the rear side wall plate, the left side wall plate, and the right side wall plate comprises a flat inner major face and at least four flat edges.

19. The sink system of claim 18, wherein each of the front left column, the rear left column, the front right column, and the rear right column comprises a first plate side and a second plate side.

* * * * *